US011726415B2

(12) United States Patent
Nagatomo

(10) Patent No.: US 11,726,415 B2
(45) Date of Patent: Aug. 15, 2023

(54) IMAGE FORMING APPARATUS THAT ADJUSTS VOLTAGE FOR CHARGING PHOTOSENSITIVE MEMBER

(71) Applicant: CANON KABUSHIKI KAISHA, Tokyo (JP)

(72) Inventor: Yuya Nagatomo, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/332,451

(22) Filed: May 27, 2021

(65) Prior Publication Data

US 2021/0389690 A1 Dec. 16, 2021

(30) Foreign Application Priority Data

Jun. 12, 2020 (JP) ..... 2020-102059

(51) Int. Cl.
*G03G 15/02* (2006.01)
*G03G 15/00* (2006.01)

(52) U.S. Cl.
CPC ..... *G03G 15/0266* (2013.01); *G03G 15/5004* (2013.01); *G03G 15/5008* (2013.01)

(58) Field of Classification Search
CPC ..... G03G 15/0266; G03G 15/5008
See application file for complete search history.

(56) References Cited

U.S. PATENT DOCUMENTS

2010/0239286 A1* 9/2010 Hanashi ..... G03G 15/0266 399/50

FOREIGN PATENT DOCUMENTS

| | | | |
|---|---|---|---|
| JP | 2000-206765 | A | 7/2000 |
| JP | 2016-188934 | A | 11/2016 |
| JP | 2016-204142 | A | 12/2016 |
| JP | 2018-040916 | A | 3/2018 |

* cited by examiner

*Primary Examiner* — Arlene Heredia
(74) *Attorney, Agent, or Firm* — Venable LLP

(57) ABSTRACT

An image forming apparatus includes a photosensitive member, a charging member configured to charge a surface of the photosensitive member, a power supply configured to apply the DC voltage to the charging member, a current detection unit configured to detect a current value flowing from the charging member to the photosensitive member, a calculation unit configured to calculate a first voltage value based on applied voltages with different voltage values and detected current values, and a setting unit configured to set a second voltage value to be applied to the charging member during forming of an image. The setting unit sets the second voltage value by adding the first voltage value, a target voltage value, and a correction value corresponding to a peripheral speed of the photosensitive member during forming of the image.

4 Claims, 10 Drawing Sheets

IMAGE FORMING APPARATUS THAT ADJUSTS VOLTAGE FOR CHARGING PHOTOSENSITIVE MEMBER

BACKGROUND OF THE INVENTION

Field of the Invention

The present invention relates to an image forming apparatus adopting an electrophotographic technique, such as a printer, a copying machine, a facsimile and a multifunction machine.

Description of the Related Art

In an image forming apparatus adopting an electrophotographic system, an electrostatic latent image is formed by an exposing unit on a photosensitive drum that has been charged by a charging device, and the electrostatic latent image is developed as a toner image using developer by a developing apparatus. A charging roller is used as the charging device, and is less likely to generate discharge products such as ozone and nitrogen oxide and requires lower application of voltage for charging compared to a corona discharger (Japanese Patent Application Laid-Open Publication No. 2000-206765). The charging roller abuts against a surface of a rotating photosensitive drum at an abutting position, and the photosensitive drum is charged by discharge generated when a DC voltage is applied to the charging roller.

DESCRIPTION OF THE EMBODIMENTS

First Embodiment

Image Forming Apparatus

The photosensitive drum is charged if the voltage applied to the charging roller is equal to or greater than a discharge start voltage for starting discharge. In order to charge the photosensitive drum to a target potential, a reference voltage value set by adding the target potential to the discharge start voltage is applied to the charging roller. However, in the actual image forming apparatus, electric resistance of the photosensitive drum and the charging roller varies according to the environment such as temperature and humidity in which the apparatus is used or by long-term use. If the discharge start voltage is not updated and the reference voltage value set based on the unchanged discharge start voltage is applied to the charging roller even though the electric resistance of the photosensitive drum and the charging roller has been changed, the photosensitive drum cannot be charged to the target potential. Hitherto, actual measurement of the current flowing to the photosensitive drum has been carried out while varying the voltage applied to the charging roller, and the discharge start voltage has been updated based on the voltage value and the measured current value.

Hitherto, however, electric charge called residual electric charge remained on the surface of the photosensitive drum before reaching the abutting position, and the residual electric charge caused the surface potential of the photosensitive drum to be varied prior to charging. In such a case, even if the discharge start voltage was updated in the manner described above and the reference voltage value, i.e., discharge start voltage plus target potential, set based on the updated discharge start voltage was applied to the charging roller, it was difficult to charge the photosensitive drum to the target potential.

SUMMARY OF THE INVENTION

According to one aspect of the present invention, an image forming apparatus includes a photosensitive member, a driving unit configured to rotate the photosensitive member, a charging member configured to charge a surface of the photosensitive member by abutting against the photosensitive member and having a DC voltage applied, an image forming unit configured to form an image on the photosensitive member being charged and to form the image on a recording material, a power supply configured to apply the DC voltage to the charging member, a current detection unit configured to detect a current value flowing from the charging member to the photosensitive member, a calculation unit configured to respectively detect current values when voltages with different voltage values each having a greater absolute value than a discharge start voltage are applied to the charging member, and calculate a first voltage value corresponding to the discharge start voltage based on the voltage values and the current values, and a setting unit configured to set a second voltage value to be applied to the charging member during forming of the image by adding the first voltage value, a target voltage value, and a correction value corresponding to a peripheral speed of the photosensitive member during forming of the image.

Further features of the present invention will become apparent from the following description of exemplary embodiments with reference to the attached drawings.

DESCRIPTION OF THE EMBODIMENTS

First Embodiment

Image Forming Apparatus

Figure 1:
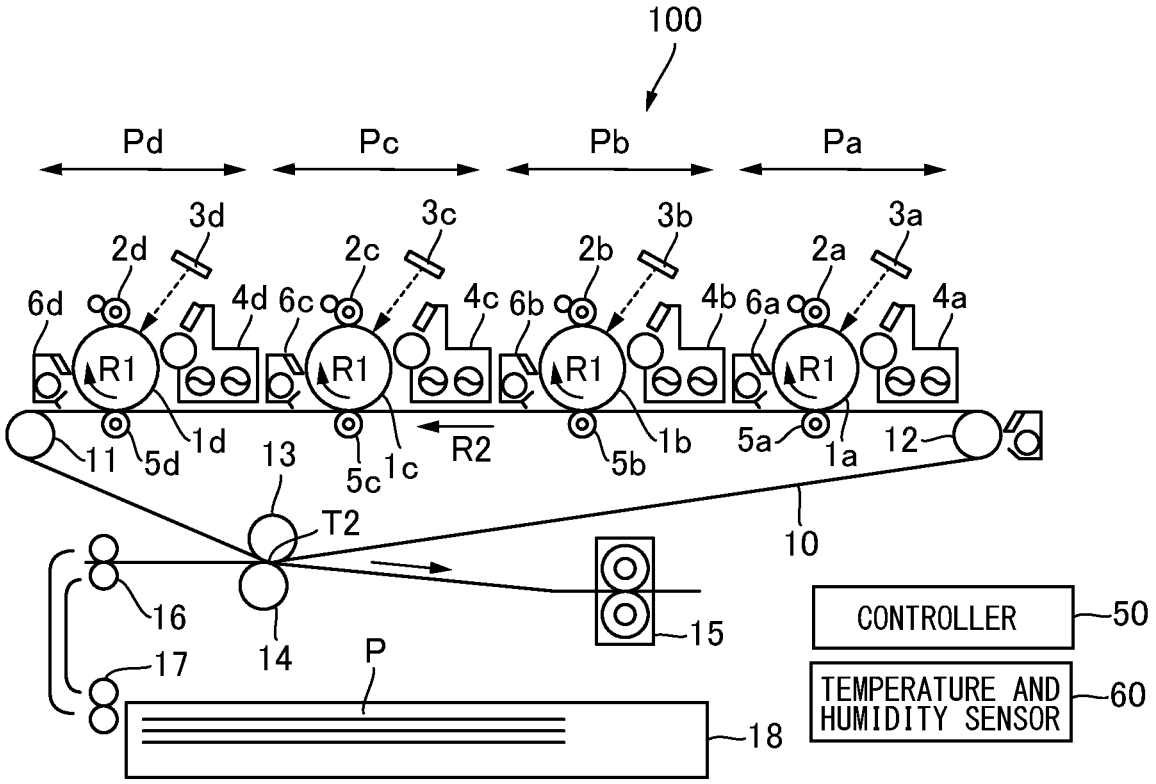
FIG. 1 is a schematic drawing illustrating a configuration of an image forming apparatus according to the present embodiment.

An image forming apparatus according to a present embodiment will be described below. At first, a schematic configuration of the image forming apparatus of the present embodiment will be described with reference to FIGS. 1 and 2. An image forming apparatus 100 illustrated in FIG. 1 is a tandem, intermediate transfer-type full color printer that includes a plurality of image forming units Pa, Pb, Pc and Pd of yellow, magenta, cyan and black arranged along an intermediate transfer belt 10 serving as an intermediate transfer body. Although not shown, the image forming apparatus 100 forms an image on a recording material P according to the image information from a document reading apparatus connected to the apparatus body or an external apparatus such as a personal computer connected to the apparatus body in a manner capable of communicating therewith. Examples of the recording material P include various papers such as plain paper, thick paper, rough paper, uneven paper, coated paper, plastic film and cloth.

In the image forming unit Pa, a yellow toner image is formed on a photosensitive drum 1*a* and primarily transferred to the intermediate transfer belt 10. In the image forming unit Pb, a magenta toner image is formed on a photosensitive drum 1*b* and primarily transferred in a superposed manner to the yellow toner image on the intermediate transfer belt 10. In the image forming units Pc and Pd, cyan and black toner images respectively formed on the photosensitive drums 1*c* and 1*d* are primarily transferred in a sequentially superposed manner on the intermediate transfer belt 10. The toner images of respective colors primarily transferred to the intermediate transfer belt 10 are borne on the intermediate transfer belt 10 and conveyed to a secondary transfer portion T2 to be secondarily transferred to the recording material P. The intermediate transfer belt 10 stretched across and supported by a tension roller 11, a driving roller 12 and a secondary transfer inner roller 13 is driven by the driving roller 12 to move in a predetermined movement direction (direction of arrow R2).

The recording material P is stored in a stacked manner in a paper feed cassette 18 and sent out by a sheet feed roller 17 from the paper feed cassette 18 at a timing matched with that of forming an image. The recording material P sent out by the sheet feed roller 17 is conveyed to a registration roller 16 arranged midway along a conveyance path. Then, after performing skew correction and timing correction of the recording material P at the registration roller 16, the recording material P is sent to the secondary transfer portion T2. The secondary transfer portion T2 is a transfer nip portion formed by the secondary transfer inner roller 13 and a secondary transfer outer roller 14, and in response to the application of a secondary transfer voltage to the secondary transfer outer roller 14 from a high voltage power supply (not shown), the toner image is secondarily transferred onto the recording material. The recording material P to which the toner image has been secondarily transferred is conveyed to a fixing unit 15. The fixing unit 15 conveys the recording material P while heating and pressing the same to fix the toner image on the recording material P. The recording material P to which the toner image has been fixed by the fixing unit 15 is discharged to the exterior of the apparatus.

The image forming units Pa, Pb, Pc and Pd will be described. The image forming units Pa, Pb, Pc and Pd adopt a similar configuration except for the different toner colors of yellow, magenta, cyan and black being used in developing apparatuses 4*a*, 4*b*, 4*c* and 4*d*, and are respectively operated according to a similar control. The image forming unit Pa using yellow toner will be described below as a representative example, and the descriptions of other image forming units Pb, Pc and Pd will be omitted. In the following description, the terms upstream and downstream respectively denote upstream and downstream directions in a rotating direction of the photosensitive drum 1*a*, unless stated otherwise.

Figure 2:
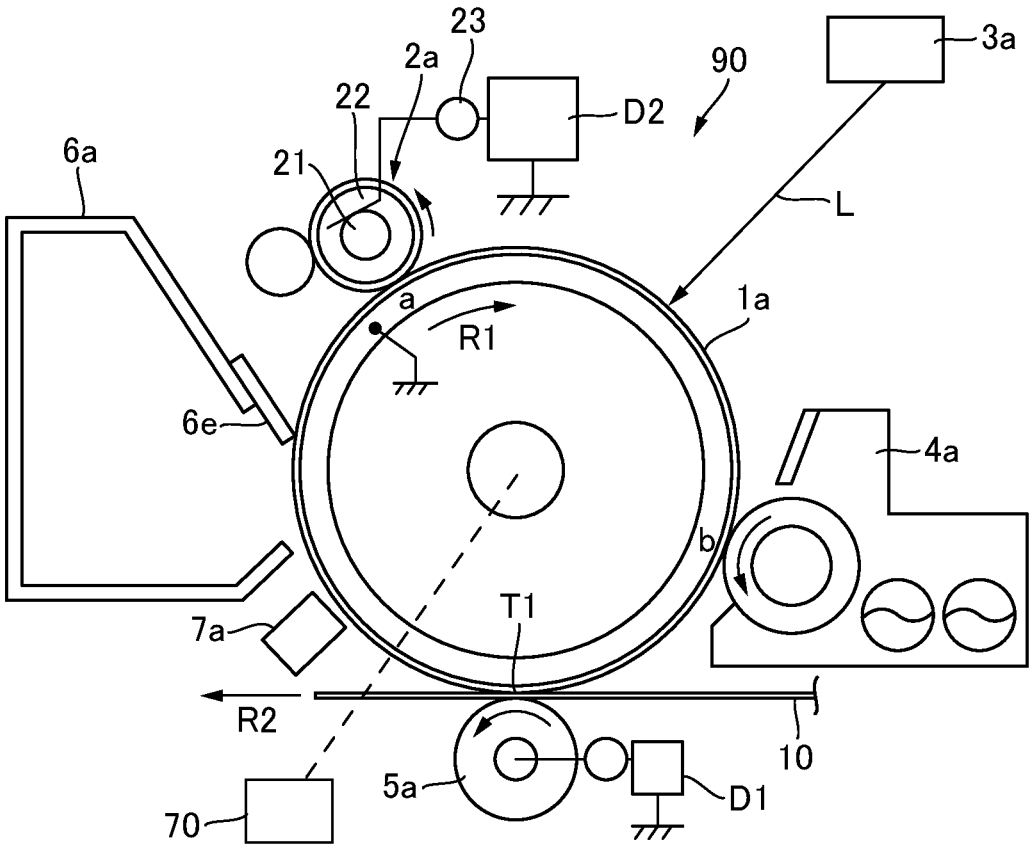
FIG. 2 is a schematic drawing illustrating an image forming unit.

As illustrated in FIG. 2, the image forming unit Pa includes a charging roller 2*a*, an exposing unit 3*a*, a developing apparatus 4*a*, a primary transfer roller 5*a*, and a cleaning device 6*a*, which are arranged in a manner surrounding the photosensitive drum 1*a*. The photosensitive drum 1*a* serving as the photosensitive member is a cylindrical organic photoreceptor drum, formed by laminating a photosensitive layer formed of an organic substance and a surface protection layer sequentially on an outer circumferential surface of a cylinder made of aluminum having conductivity. The photosensitive drum 1*a* is provided rotatably in the rotating direction (direction of arrow R1) at a peripheral speed of "320 mm/sec", for example, by a drum driving motor 70 serving as a driving unit. The drum driving motor 70 can rotate the photosensitive drum 1*a* at various peripheral speeds according, for example, to the type of the recording material P to which image is being formed.

The charging roller 2*a* serving as a charging member is a contact charging member that is formed in the shape of a roller. The charging roller 2*a* abuts against the photosensitive drum 1*a* at an abutting position a, and it is driven to rotate along with the photosensitive drum 1*a*. To realize such arrangement, the charging roller 2*a* is pressed against the photosensitive drum 1*a* with a predetermined contact pressure. In a state where DC voltage is applied to the charging roller 2*a* from a charging power supply D2, discharge is caused between the charging roller 2*a* and the rotating photosensitive drum 1*a*, by which the surface of the photosensitive drum 1*a* is uniformly changed. The charging roller 2*a* is not limited to being rotated by the photosensitive drum 1*a*, and it can also be rotated independently from the photosensitive drum 1*a* using a motor, for example. In this description, DC voltage is not limited to containing only DC component but also includes voltage containing both DC component and AC component.

According to the present embodiment, an ammeter 23 serving as a current detection unit for detecting the amount of current flowing between the charging roller 2*a* and the photosensitive drum 1*a* when a DC voltage is applied from the charging power supply D2 is connected to the charging roller 2*a*. Since the DC voltage is applied from the charging power supply D2, the ammeter 23 can detect the amount of current by subjecting the DC current component to time resolution. The time resolving ability of the ammeter 23 is preferably "5 msec" or smaller and desirably "1 msec" or smaller.

As for the charging roller 2*a*, a conductive core metal 21 is used as a base that serves as a shaft and an elastic layer 22 is provided on the conductive core metal 21. Metal material such as iron, copper, stainless steel and aluminum can be used as the conductive core metal 21, and in the present embodiment, aluminum is used. Plating for rust prevention and scratch resistance can be applied for a certain amount so as not to deteriorate its conductivity. The elastic layer 22 of the charging roller 2*a* is formed in a crown shape having a thick center portion and narrow end portions with respect to the rotational axis direction, considering the influence of deflection when pressure is applied to the photosensitive drum 1*a*. This is because both ends of the charging roller 2*a* are configured to receive a predetermined pressing force toward the photosensitive drum 1*a* by a pressurization mechanism (not shown). That is, since the contact pressure at the center portion of the charging roller 2*a* to the photosensitive drum 1*a* tends to be smaller than the pressure at both ends thereof, the above-described arrangement is adopted to prevent such uneven pressure. Further, carbon black serving as a conducting agent is dispersed in rubber (EPDM (ethylene-propylene-diene rubber)) serving as an elastic material forming the elastic layer 22 of the charging roller 2*a*, so that a resistance thereof is adjusted to be smaller than "$1\times10^{10}$ Ωcm". As an example, the present embodiment uses the charging roller 2*a* having an outer diameter of "12 mm", a diameter of the conductive core metal 21 of "8 mm", and the resistance thereof adjusted to "$1\times10^{6}$ Ωcm" by adding a conductive agent to the elastic layer 22.

An electron-conducting agent such as graphite or conductive metal oxide, or an ion-conducting agent, such as alkaline metal salt, can be used as the conducting agent of the charging roller 2*a*. A natural rubber or a synthetic rubber such as SBR, silicone rubber, urethane rubber, synthetic rubber, IR, BR, NBR or CR, a polyamide resin, a polyurethane resin or a silicon resin can be used as the elastic material of the charging roller 2*a*.

The photosensitive drum 1*a* is uniformly charged to a predetermined target potential by the charging roller 2*a* described above before being subjected to image exposure (laser light L) by the exposing unit 3*a*. The exposing unit 3*a* generates, from a laser light-emitting element, laser light L having a wavelength of "780 nm", for example, corresponding to the image data of scanning lines obtained by developing separated color image and subjecting the same to on-off modulation, scans the laser light L using a rotary mirror, and forms an electrostatic latent image on the charged photosensitive drum 1*a*. The developing apparatus 4*a* develops the electrostatic latent image formed on the photosensitive drum 1*a* as a toner image using developer at a developing position b.

The primary transfer roller 5*a* is arranged to oppose the photosensitive drum 1*a* with the intermediate transfer belt 10 interposed therebetween, forming a primary transfer nip portion T1 of toner image between the photosensitive drum 1*a* and the intermediate transfer belt 10. A primary transfer power supply D1 is connected to the primary transfer roller 5*a*, and the toner image on the photosensitive drum 1*a* is primarily transferred to the intermediate transfer belt 10 by having a DC voltage, i.e., primary transfer voltage, having an opposite polarity as charged polarity of toner, applied from the primary transfer power supply D1.

The cleaning device 6*a* is provided at a position upstream of the charging roller 2*a* and downstream of the primary transfer roller 5*a*. The cleaning device 6*a* includes a cleaning blade 6*e* made of polyurethane rubber that abuts against the photosensitive drum 1*a* and removes untransferred, residual toner remaining on the photosensitive drum 1*a* after primary transfer by mechanically wiping off the residual toner.

In the present embodiment, a destaticizing exposing unit 7*a* for destaticizing the surface of the photosensitive drum 1*a* is provided at the position upstream of the cleaning blade 6*e* and downstream of the primary transfer roller 5*a*. The destaticizing exposing unit 7*a* irradiates the surface of the photosensitive drum 1*a* with laser light having a strength that differs from that of the exposing unit 3*a* so as to reduce electric charge, which is referred to as residual electric charge, remaining on the surface of the photosensitive drum 1*a* after primary transfer and thereby reduce a surface potential of the photosensitive drum 1*a*. Specifically, although not shown, the destaticizing exposing unit 7*a* irradiates light from an LED lamp that is arranged on a light guide serving as a light guiding member, and destaticizes the surface of the photosensitive drum 1*a* by the light being reflected on and guided by the light guide. Resin having superior light transmittance, such as acryl, polycarbonate, or polystyrene, or glass, can be used as the light guide. The number of light guides provided in the LED lamp is not limited to one, and two or more light guides can be provided if there is insufficient light. The destaticizing exposing unit is not shown in FIG. 1.

Controller

Further, as shown in FIG. 1, a controller 50 capable of generally controlling the operation of the image forming apparatus 100 is provided in the image forming apparatus 100, as illustrated in FIG. 1. In the present description, the controller 50 mainly relates to a charge control system for charging the photosensitive drum 1*a*, which will be described based on FIG. 3 with reference to FIGS. 1 and 2. Other than those illustrated in FIG. 3, various units composing the image forming apparatus 100 and various devices such as power supplies or motors for driving the respective units are connected to the controller 50. However, such units and devices are not related to the main object of the present technique, so they are not shown in the drawing and descriptions thereof are omitted.

The controller 50 controls various operations related to image forming processes, and for example, includes a CPU (Central Processing Unit) 51 and a memory 52. The memory 52 is composed of a ROM (Read Only Memory) and a RAM (Random Access Memory), for example. The memory 52 stores various programs for controlling the image forming apparatus 100 and various data such as a "discharge start voltage" or a "voltage correction table" (described later) used for setting the voltage (hereinafter referred to as charging voltage) to be applied to the charging roller 2*a* for forming images. Further, the controller 50 can count the number of sheets of recording material P on which image has been formed, more particularly, the number of formed images on recording material P. Thereby, the controller 50 can store the counted number of sheets of recording material P in the memory 52.

According to the present embodiment, the controller 50 can control the voltage applied to the charging roller 2*a* by the charging power supply D2. In a state where the controller 50 applies voltage to the charging roller 2*a* from the charging power supply D2, the current value of the current flowing from the charging roller 2*a* to the photosensitive drum 1*a* can be acquired by the ammeter 23.

The controller 50 can execute various programs such as an "image forming job processing" (not shown) for forming an image on the recording material P, an "actual measurement processing" or a "charging voltage-setting processing" mentioned later, and the controller 50 executes these various programs to control the operation of respective units of the image forming apparatus 100. In a state where the "charging voltage-setting processing" is executed, the controller 50 uses the "discharge start voltage" and a correction value from the "voltage correction table" stored in the memory 52 to set the charging voltage to be applied to the charging roller 2*a* from the charging power supply D2. The details of this operation will be described later. The memory 52 can also temporarily store a result of calculation processing accompanying execution of various programs or image information received from a document reading apparatus or an external apparatus.

According further to the present embodiment, a temperature and humidity sensor 60 serving as a humidity detection unit is arranged in the apparatus body of the image forming apparatus 100. The controller 50 can specify an absolute moisture amount based on the temperature and humidity information acquired by the temperature and humidity sensor 60.

Figure 4:
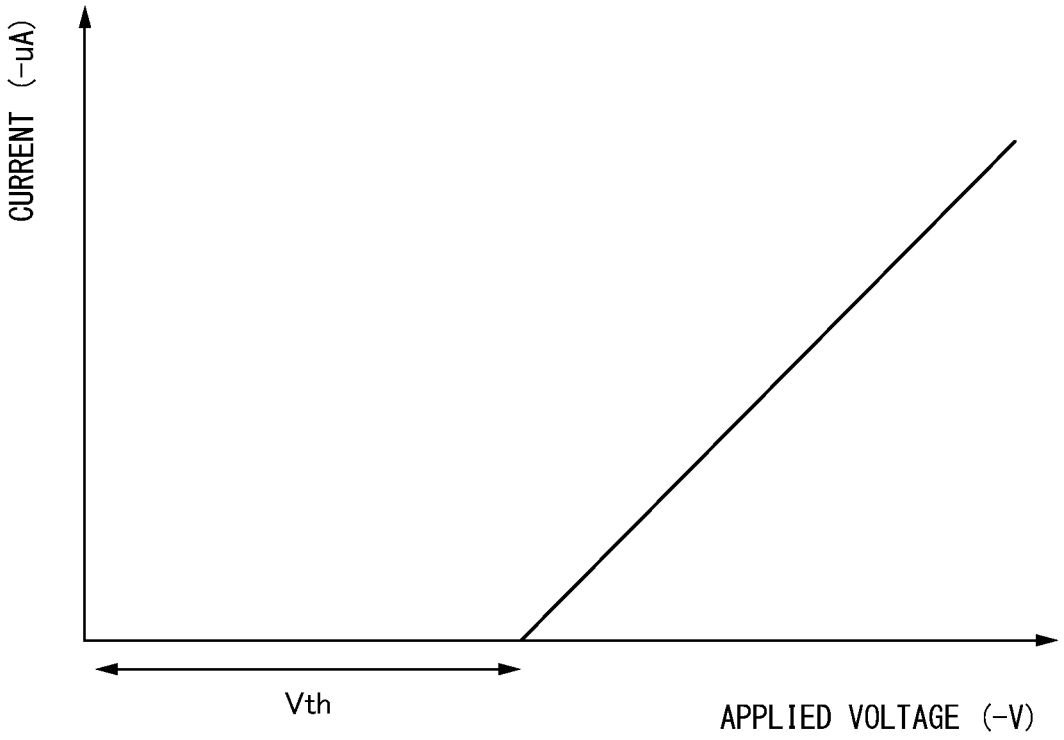
FIG. 4 is a graph illustrating a relationship between an applied voltage applied to a charging roller and a current flowing to a photosensitive drum.
Figure 5:
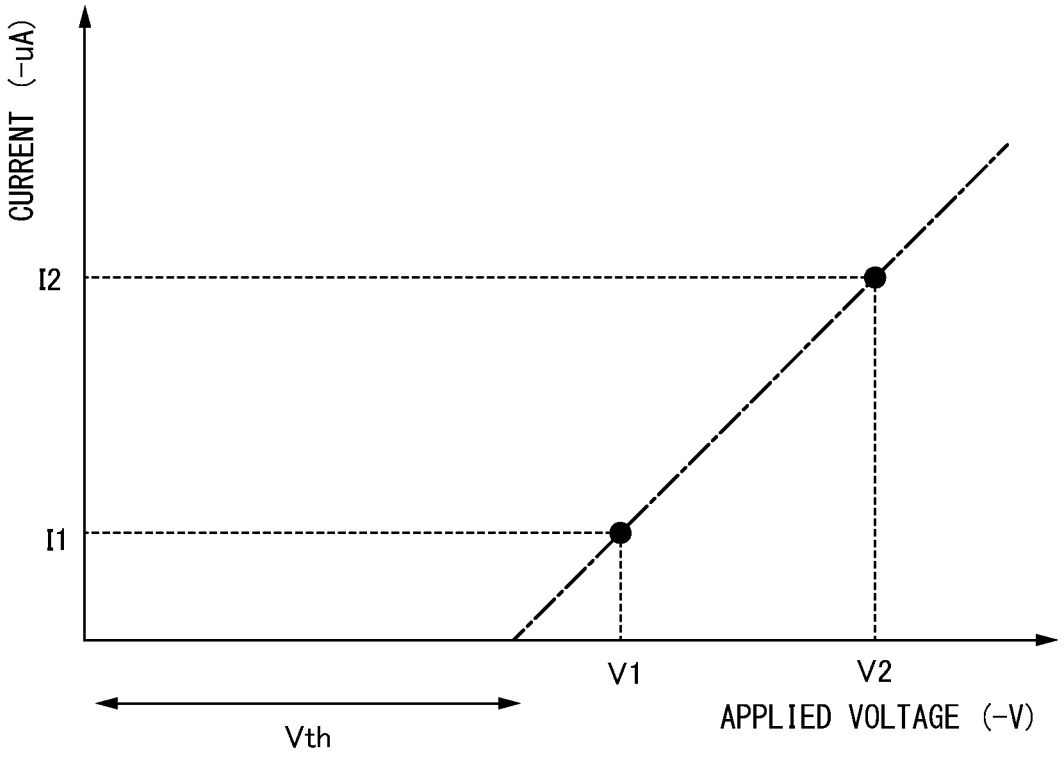
FIG. 5 is a graph illustrating an actual measurement method for measuring a discharge start voltage.

According to the present embodiment, the controller 50 serving as a calculation unit can execute an "actual measurement processing", i.e., actual measurement mode, for actually measuring a discharge start voltage (Vth) in which discharge is started between the photosensitive drum 1*a* and the charging roller 2*a*. The "actual measurement processing" will be described. FIG. 4 is a graph that shows a relationship between an applied voltage (−V) applied to the charging roller 2*a* and a current (−μA) that flows through the charging roller 2*a* to the photosensitive drum 1*a* according to the applied voltage. FIG. 5 is a graph illustrating an actual measurement method of the discharge start voltage.

In a state where DC voltage is applied to the charging roller 2*a*, as illustrated in FIG. 4, discharge between the photosensitive drum 1*a* and the charging roller 2*a* is started if the applied DC voltage (referred to as applied voltage for convenience) is equal to the above-mentioned discharge start voltage (Vth) or greater, and the surface of the photosensitive drum 1*a* is charged. Hitherto, in order to charge the surface of the photosensitive drum 1*a* to the target potential (Vd), the controller 50 sets a voltage "Vth+Vd" (referred to as reference voltage value for distinction) obtained by adding a target potential (Vd) as a target voltage value to the discharge start voltage (Vth) as the charging voltage to be applied to the charging roller 2*a*.

However, the discharge start voltage (Vth) can vary, for example, by the influence of the environment, such as the temperature and the humidity, of the location in which the image forming apparatus 100 is installed, or deterioration with time of the photosensitive drum 1*a* or the charging roller 2*a*, such as reduction of layer thickness by scraping. If the charging voltage is set without considering such variation of discharge start voltage (Vth), the photosensitive drum 1*a* may not be charged to the target potential. Therefore, hitherto, the discharge start voltage (Vth) was actually measured based on the applied voltage applied to the charging roller 2*a* and the current flowing to the photosensitive drum 1*a* through the charging roller 2*a* accompanying voltage application, and the charging voltage was set based on the discharge start voltage (Vth) that had been actually measured.

The operation will be described specifically with reference to FIGS. 1 and 2. At first, the controller 50 destaticizes the photosensitive drum 1*a* by the destaticizing exposing unit 7*a*. After destaticizing the photosensitive drum 1*a*, as illustrated in FIG. 5, the controller 50 applies the two voltages V1 and V2 equal to or greater than the charge start voltage, i.e., discharge start voltage, Vth from the charging power supply D2 to the charging roller 2*a* and detects the currents I1 and I2 that flow accompanying the application of the respective voltages by the ammeter 23. In FIG. 5, the applied voltage when the current (I) is "0" is the "discharge start voltage (Vth)", and the controller 50 can calculate the discharge start voltage (Vth) as a first voltage value by the following expression (1).

$$Vth=(V1\times I2-V2\times I1)/(I2-I1) \quad \text{Expression (1)}$$

By actually measuring the discharge start voltage (Vth) in the above-described manner and setting the charging voltage based on the actual measurement, a potential measuring apparatus will no longer be necessary for measuring the surface potential of the photosensitive drum 1*a*, so that this arrangement is preferable from the viewpoint of reducing the number of components and downsizing of the apparatus.

However, there were cases according to the conventional technique described above where the photosensitive drum 1*a* could not be charged to the target potential even though the charging voltage (Vc) was set based on the actually measured discharge start voltage (Vth). The present inventors have studied these cases and discovered that the amount of residual electric charge on the surface of the photosensitive drum 1*a* after primary transfer before reaching the "abutting position a" illustrated in FIG. 2 had varied, and the surface potential of the photosensitive drum 1*a* before being charged had changed. In such cases, even if the reference voltage value (Vth+Vd) obtained by adding the target potential (Vd) to the discharge start voltage (Vth) subjected to actual measurement is set as the charging voltage (Vc=Vth+Vd), the surface of the photosensitive drum 1*a* could not be charged to the target potential. That is, the surface potential of the photosensitive drum 1*a* after passing the charging roller 2*a* had been influenced by residual electric charge in addition to the electric charge applied by discharge. Therefore, according to the present embodiment, the reference voltage value (Vth+Vd) determined by the discharge start voltage (Vth) and the target potential (Vd) is corrected based on the "information regarding residual electric charge", and the corrected value is set as the charging voltage. The "charging voltage-setting processing" according to the present embodiment for realizing such processing will be described below.

Charging Voltage-Setting Processing

Now, the "charging voltage-setting processing" according to the first embodiment will be described based on FIG. 6 with reference to FIGS. 2, 3 and 5. The "charging voltage-setting processing" is started by the controller 50 at a matched timing with the turning on of the power supply of the image forming apparatus 100, and the processing is repeatedly performed until the power supply is turned off.

Figure 6:
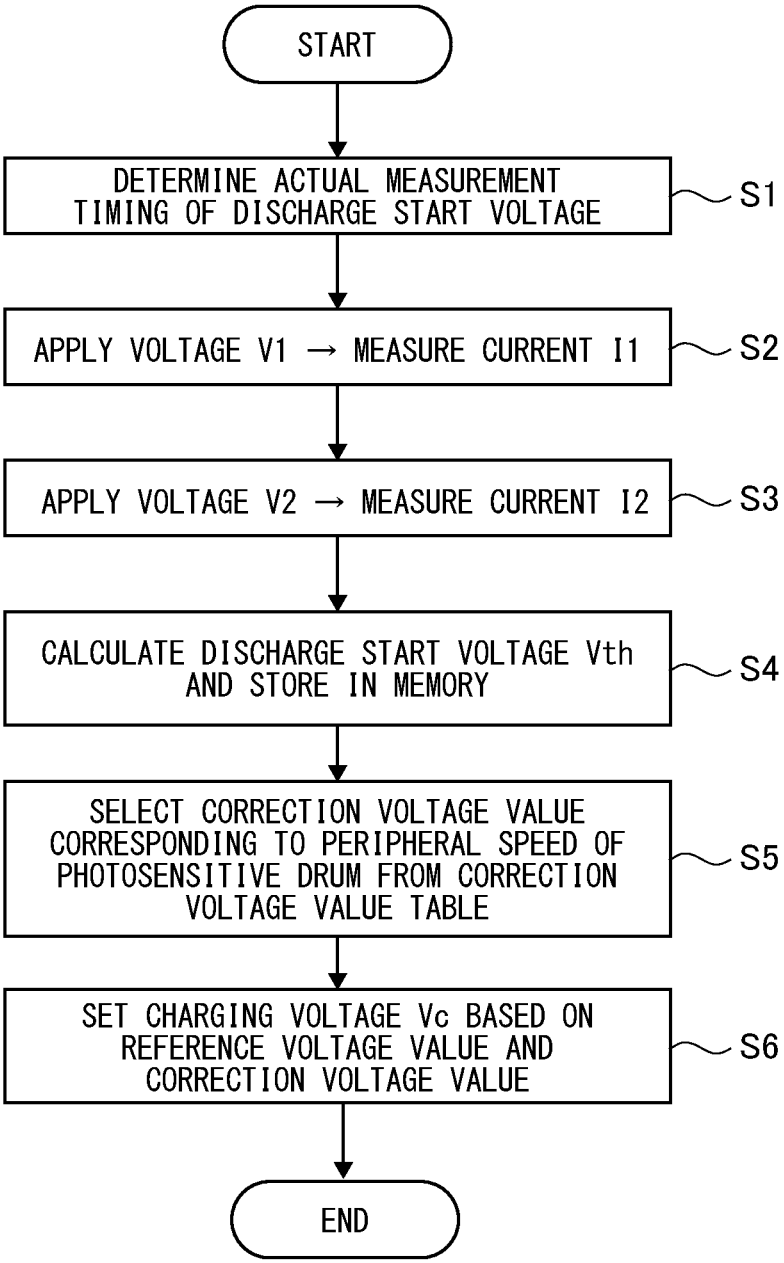
FIG. 6 is a flowchart illustrating a charging voltage-setting processing according to a first embodiment.

As illustrated in FIG. 6, at an actual measurement timing of "discharge start voltage" (S1), the controller 50 executes processes illustrated in steps S2 to S4 and performs actual measurement of the "discharge start voltage" described above. That is, the controller 50 applies a voltage (V1, refer to FIG. 5) to the charging roller 2*a* from the charging power supply D2, and a current (I1, refer to FIG. 5) corresponding to the voltage application is measured by the ammeter 23 (S2). Thereafter, the controller 50 applies a voltage (V2, refer to FIG. 5) that is greater than the voltage (V1) from the charging power supply D2 to the charging roller 2*a*, and a current (I2, refer to FIG. 5) corresponding to the voltage application is measured by the ammeter 23 (S3). Then, the controller 50 calculates the discharge start voltage (Vth) based on the above-mentioned Expression (1) and stores the same in the memory 52 (S4). That is, the processes of steps S2 to S4 correspond to the "actual measurement processing" described above. The controller 50 will not perform the processes of steps S2 to S4 if it is not the actual measurement timing of the "discharge start voltage". In that case, the value already stored in the memory 52 is used as the discharge start voltage (Vth) for the following processes.

The controller 50 refers to the "correction voltage value table" stored in the memory 52 and selects the "correction voltage value" corresponding to the peripheral speed of the photosensitive drum 1*a* rotated by the drum driving motor 70 (S5). Table 1 is an example of a "correction voltage value table" of a case where the peripheral speed of the photosensitive drum 1*a* is adopted as "information regarding residual electric charge".

TABLE 1

| PERIPHERAL SPEED (mm/sec) | 320 | 250 | 130 |
|---|---|---|---|
| CORRECTION VOLTAGE VALUE (V) | 35 | 25 | 0 |

The "correction voltage value table" illustrated in Table 1 defines "correction voltage values" corresponding to peripheral speeds of the photosensitive drum 1*a*. A case where the drum driving motor 70 rotates the photosensitive drum 1*a* to one of three peripheral speeds, which are "320 mm/sec", "250 mm/sec" and "130 mm/sec", is illustrated as an example. The controller 50 selects the "correction voltage value" to be "35 V" if the peripheral speed is "320 mm/sec", "25 V" if the peripheral speed is "250 mm/sec" and "0 V" if the peripheral speed is "130 mm/sec". That is, in a case where the peripheral speed of the photosensitive drum 1*a* is a "first speed", a "first correction value" among the plurality of correction voltage values defined in the "correction voltage value table" is selected. In a state where the peripheral speed of the photosensitive drum 1*a* is a "second speed" that is faster than the "first speed", the "second correction value" that is greater than the "first correction value" among the plurality of correction voltage values defined in the "correction voltage value table" is selected.

If the peripheral speed of the photosensitive drum 1*a* is high, the time required for the surface of the photosensitive drum 1*a* after primary transfer to reach the "abutting position a" is shortened, so that there is much residual electric charge, and the surface of the photosensitive drum 1*a* reaches the "abutting position a" in a state where the surface potential is high. Even when destaticizing is carried out by the destaticizing exposing unit 7*a*, if the peripheral speed of the photosensitive drum 1*a* is high, the residual electric charge cannot be sufficiently destaticized before the surface of the photosensitive drum 1*a* reaches the "abutting position a". In that case, as has been already described, even if the above-described reference voltage value is applied as the charging voltage to the charging roller 2*a*, the photosensitive drum 1*a* cannot be charged to the target potential.

Thus, the controller 50 serving as a setting unit corrects the reference voltage value based on the "correction voltage value" selected according to the peripheral speed of the photosensitive drum 1*a* and sets the corrected value, i.e., a second voltage value, as the charging voltage. Specifically, the controller 50 sets the charging voltage (Vc) based on the following expression (2) (S6). The controller 50 applies the charging voltage (Vc) set in the manner described above from the charging power supply D2 to the charging roller 2*a*, by which the surface potential of the photosensitive drum 1*a* can be charged to the target potential (Vd) regardless of the peripheral speed of the photosensitive drum 1*a*.

$$\text{Charging voltage } (Vc) = \text{reference voltage value } (Vth + Vd) - \text{correction voltage value} \qquad \text{Expression (2)}$$

As described, according to the present embodiment, the charging voltage (Vc) applied to the charging roller 2*a* for charging the photosensitive drum 1*a* is set using the "correction voltage value" corresponding to the "peripheral speed of the photosensitive drum 1*a*" that influences the residual electric charge remaining on the surface of the photosensitive drum 1*a*. By applying the charging voltage (Vc) set in this manner to the charging roller 2*a*, the surface potential of the photosensitive drum 1*a* can be charged to an appropriate potential, i.e., target potential, regardless of the residual electric charge remaining on the surface of the photosensitive drum 1*a* that depends on the peripheral speed of the photosensitive drum 1*a*. In other words, since the photosensitive drum 1*a* can be charged to target potential even if the surface potential of the photosensitive drum 1*a* prior to being charged and reaching the abutting position with the charging roller 2*a* is varied due to the residual electric charge remaining on the surface of the photosensitive drum 1*a*, image defects caused by residual electric charge will not easily occur to the recording material P.

Second Embodiment

The first embodiment has been described based on an example where the peripheral speed of the photosensitive drum 1*a* has been adopted as the "information regarding residual electric charge", but the present technique is not limited thereto. The "information regarding residual electric charge" can adopt the environment, more particularly, an absolute moisture amount, of the location in which the image forming apparatus 100 is installed. The "charging voltage-setting processing" of such a case according to a second embodiment will be described based on FIG. 7 with reference to FIGS. 2 and 3. The processes of steps S1 to S4 of the "charging voltage-setting processing" according to the second embodiment are the same as those of the "charging voltage-setting processing" according to the first embodiment (refer to FIG. 6), so detailed descriptions thereof are omitted.

Figure 7:
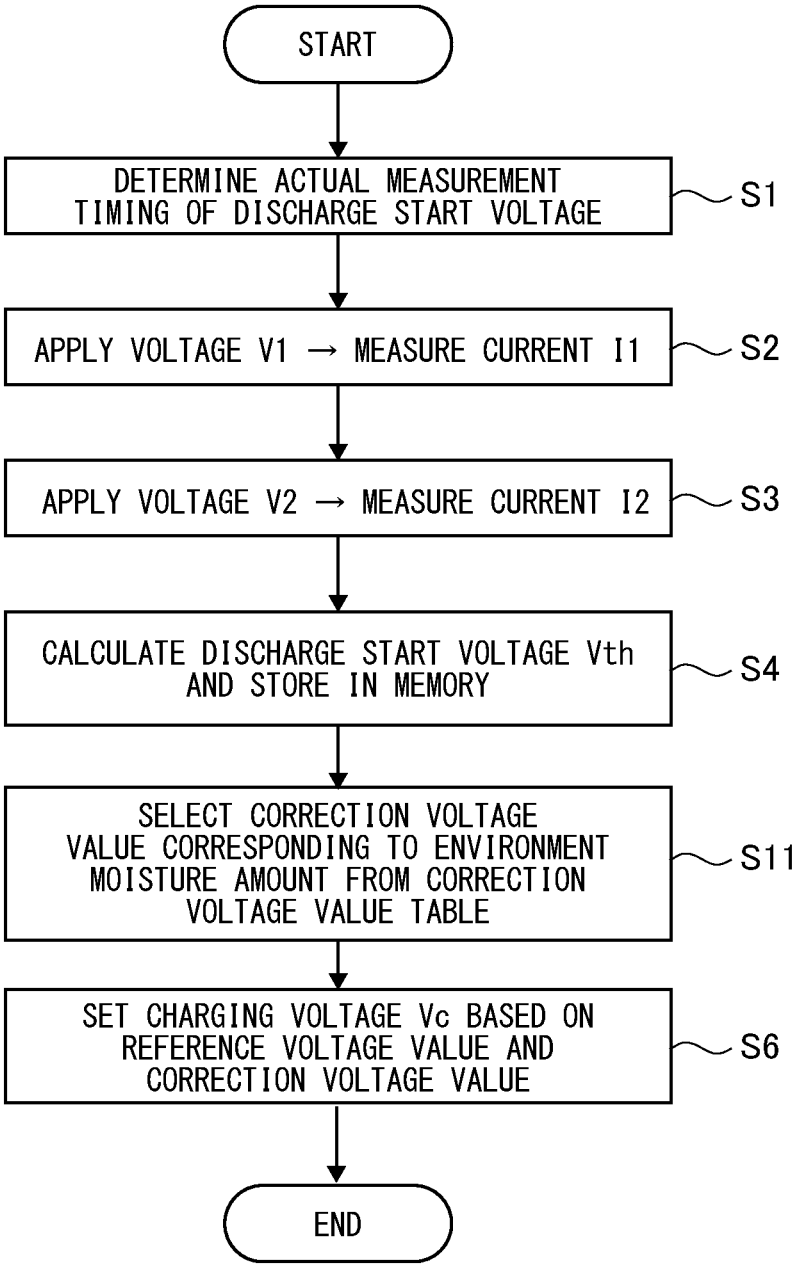
FIG. 7 is a flowchart illustrating a charging voltage-setting processing according to a second embodiment.

As illustrated in FIG. 7, the controller 50 refers to a "correction voltage value table" stored in the memory 52 and selects a correction voltage value corresponding to an absolute moisture amount specified based on temperature and humidity acquired by the temperature and humidity sensor 60 (S11). Table 2 shows an example of a "correction voltage value table" of a case where the absolute moisture amount is adopted as the "information regarding residual electric charge".

TABLE 2

| | MOISTURE AMOUNT (g/kgDA) | | | | | | | |
|---|---|---|---|---|---|---|---|---|
| | 0.86 | 3.5 | 6.12 | 8.73 | 12.21 | 15.69 | 18.62 | 21.54 |
| CORRECTION VOLTAGE VALUE (V) | 50 | 47 | 44 | 41 | 38 | 35 | 32 | 30 |

The "correction voltage value table" illustrated in Table 2 defines "correction voltage values" corresponding to absolute moisture amounts. In the table, the correction voltage value is defined to be "50 V" if the absolute moisture amount (unit: g/kg DA) is "0.86" or lower, "47 V" if the absolute moisture amount is "greater than 0.86 to 3.5", "44 V" if the absolute moisture amount is "greater than 3.5 to 6.12", and "41 V" if the absolute moisture amount is "greater than 6.12 to 8.73". Further, the correction voltage value is defined to be "38 V" if the absolute moisture amount is "greater than 8.73 to 12.21", "35 V" if the absolute moisture amount is "greater than 12.21 to 15.69", "32 V" if the absolute moisture amount is "greater than 15.69 to 18.62", and "30 V" if the absolute moisture amount is "greater than 18.62 to 21.54". Therefore, if the absolute moisture amount is a "first moisture amount", a "first correction value" among the plurality of correction voltage values defined in the "correction voltage value table" is selected. If the absolute moisture amount is a "second moisture amount" that is lower than the "first moisture amount", a "second correction value" that is greater than the "first correction value" among the plurality of correction voltage values defined in the "correction voltage value table" is selected.

If the absolute moisture amount is low, the residual electric charge will not be easily eliminated before the surface of the photosensitive drum 1*a* after primary transfer reaches the "abutting position a", so that there is much residual electric charge, and the surface of the photosensitive drum 1*a* reaches the "abutting position a" in a state where the surface potential is high. Even if destaticization is carried out by the destaticizing exposing unit 7*a*, if the absolute moisture amount is low, residual electric charge is not easily eliminated, and the surface of the photosensitive drum 1*a* will reach the "abutting position a" in a state where the surface potential is high. In that case, as has been already described, the photosensitive drum 1*a* cannot be charged to the target potential even if the above-described reference voltage value is applied to the charging roller 2*a* as the charging voltage.

Therefore, the controller 50 serving as a setting unit corrects the reference voltage value based on the "correction voltage value selected according to the absolute moisture amount" and sets the corrected value, i.e., a second voltage value, as the charging voltage. The controller 50 sets the charging voltage (Vc) based on the Expression (2) stated above (S6). By applying the charging voltage (Vc) set in the above-described manner to the charging roller 2*a*, the surface potential of the photosensitive drum 1*a* can be charged to the target potential (Vd) regardless of the residual electric charge remaining on the surface of the photosensitive drum 1*a* that depends on the absolute moisture amount.

Third Embodiment

A number of sheets of recording material P on which an image has been formed in the image forming apparatus 100, more particularly, the number of formed images on recording material P, can also be adopted as the "information regarding residual electric charge". The "charging voltage-setting processing" of the third embodiment in such a case will be described based on FIG. 8 with reference to FIGS. 2 and 3. The processes of steps S1 to S4 of the "charging voltage-setting processing" according to the third embodiment are the same as those of the "charging voltage-setting processing" according to the first embodiment (refer to FIG. 6), so detailed descriptions thereof are omitted.

Figure 8:
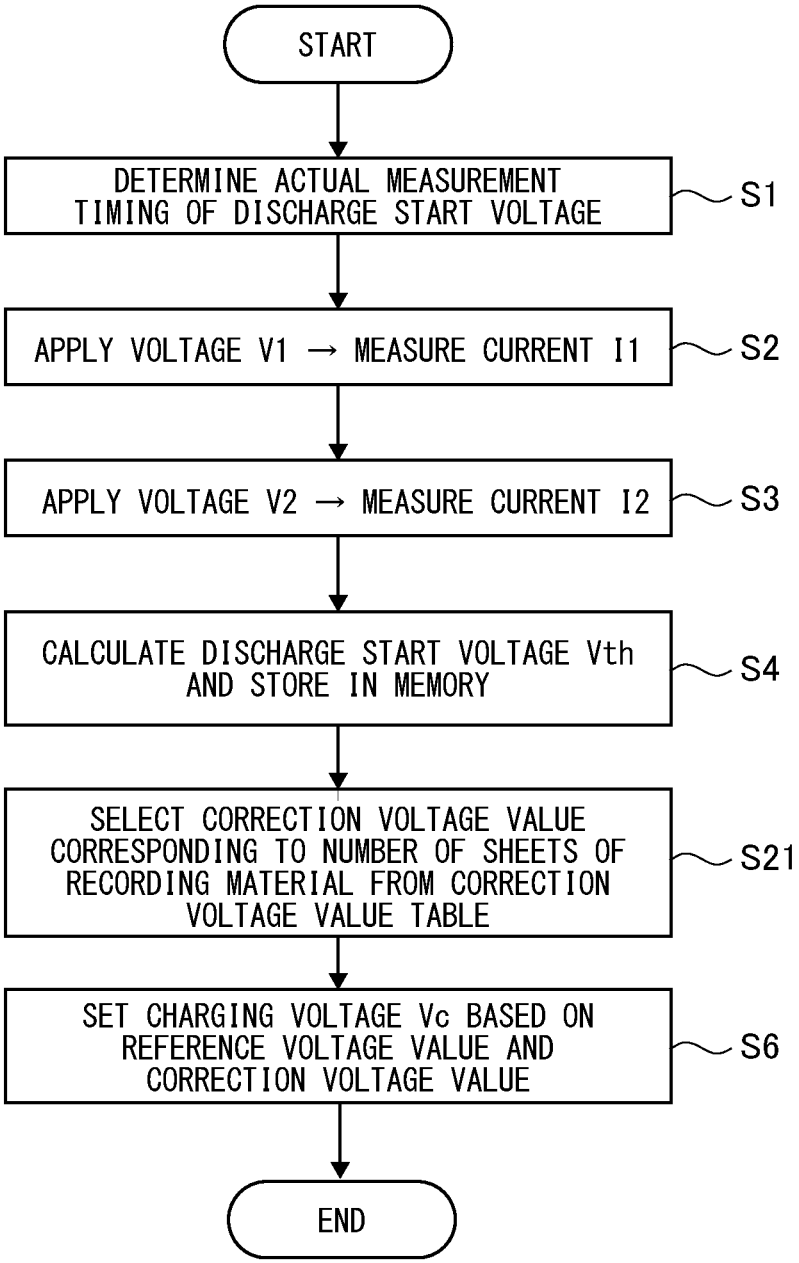
FIG. 8 is a flowchart illustrating a charging voltage-setting processing according to a third embodiment.

As illustrated in FIG. 8, the controller 50 refers to a "correction voltage value table" stored in the memory 52 and selects a correction voltage value corresponding to a counted number of sheets of recording material P (S21). Table 3 shows an example of a "correction voltage value table" of a case where the number of sheets of recording material P is adopted as the "information regarding residual electric charge".

TABLE 3

| | NUMBER OF SHEETS (K) | | | | | | |
|---|---|---|---|---|---|---|---|
| | 0 | 50 | 100 | 150 | 200 | 250 | 300 |
| CORRECTION VOLTAGE VALUE (V) | 35 | 40 | 45 | 50 | 55 | 60 | 65 |

The "correction voltage value table" illustrated in Table 3 defines "correction voltage values" corresponding to the number of sheets of recording material P. In the table, the correction voltage value is defined to be "35 V" if the number of sheets of recording material P (unit: 1000 sheets) is "0 to below 50", "40 V" if the number of sheets is "50 to below 100", "45 V" if the number of sheets is "100 to below 150", and "50 V" if the number of sheets is "150 to below 200". Further, the correction voltage value is defined to be "55 V" if the number of sheets is "200 to below 250", "60 V" if the number of sheets is "250 to below 300", and "65 V" if the number of sheets is "300 or more". Therefore, if the number of sheets of recording material P is a "first number of sheets", a "first correction value" among the plurality of correction voltage values defined in the "correction voltage value table" is selected. If the number of sheets of recording material P is a "second number of sheets" that is greater than the "first number of sheets", a "second correction value" that is greater than the "first correction value" among the plurality of correction voltage values defined in the "correction voltage value table" is selected.

If the number of sheets of recording material P on which an image has been formed is high, the deterioration with time of the photosensitive drum 1*a* and the charging roller 2*a* that rotate in a manner abutting against one another, such as the reduction of layer thickness caused by scraping, may be advanced. If deterioration with time of the photosensitive drum 1*a* or the charging roller 2*a* is advanced, the surface of the photosensitive drum 1*a* may tend to reach the "abutting position a" with a high surface potential having much residual electric charge remaining before the surface of the photosensitive drum 1*a* after primary transfer reaches the "abutting position a". Even if destaticization is carried out by the destaticizing exposing unit 7*a*, residual electric charge will easily remain by the advancement of deterioration with time, and the surface of the photosensitive drum 1*a* will reach the "abutting position a" in a state where the surface potential is high. In that case, as has been already described, the photosensitive drum 1*a* cannot be charged to the target potential even if the above-described reference voltage value is applied to the charging roller 2*a* as the charging voltage.

Therefore, the controller 50 serving as a counting portion or as a setting unit counts the number of sheets of recording material P, corrects the reference voltage value based on the "correction voltage value" selected according to the counted number of sheets and sets the corrected value, i.e., a second voltage value, as the charging voltage. The controller 50 sets the charging voltage (Vc) based on the Expression (2) stated above (S21). By applying the charging voltage (Vc) set in the above-described manner to the charging roller 2*a*, the surface potential of the photosensitive drum 1*a* can be charged to the target potential (Vd) regardless of the residual electric charge remaining on the surface of the photosensitive drum 1*a* that depends on the deterioration with time of the photosensitive drum 1*a* or the charging roller 2*a*.

Further, it is possible to combine the above-described "peripheral speed of the photosensitive drum 1*a*", the "absolute moisture amount" and the "number of sheets of recording material P" and adopt such combination as the "information regarding residual electric charge". In such a case, tables defining the relationship between the peripheral speeds of the photosensitive drum 1*a* (such as for 320, 250 and 130 (mm/sec)) and the "correction voltage value tables" shown in Tables 2 and 3 should be stored in the memory 52.

Changing of Correction Voltage Value

The photosensitive drum 1*a* can be combined with the charging roller 2*a*, the cleaning device 6*a* and the destaticizing exposing unit 7*a* (refer to FIG. 2) to form an integrated unit serving as a drum cartridge, which is exchangeable in the apparatus body of the image forming apparatus 100. In that case, although not shown, a door through which the drum cartridge can be exchanged is provided on the image forming apparatus 100, and the user can open the door to exchange the drum cartridge.

Figure 3:
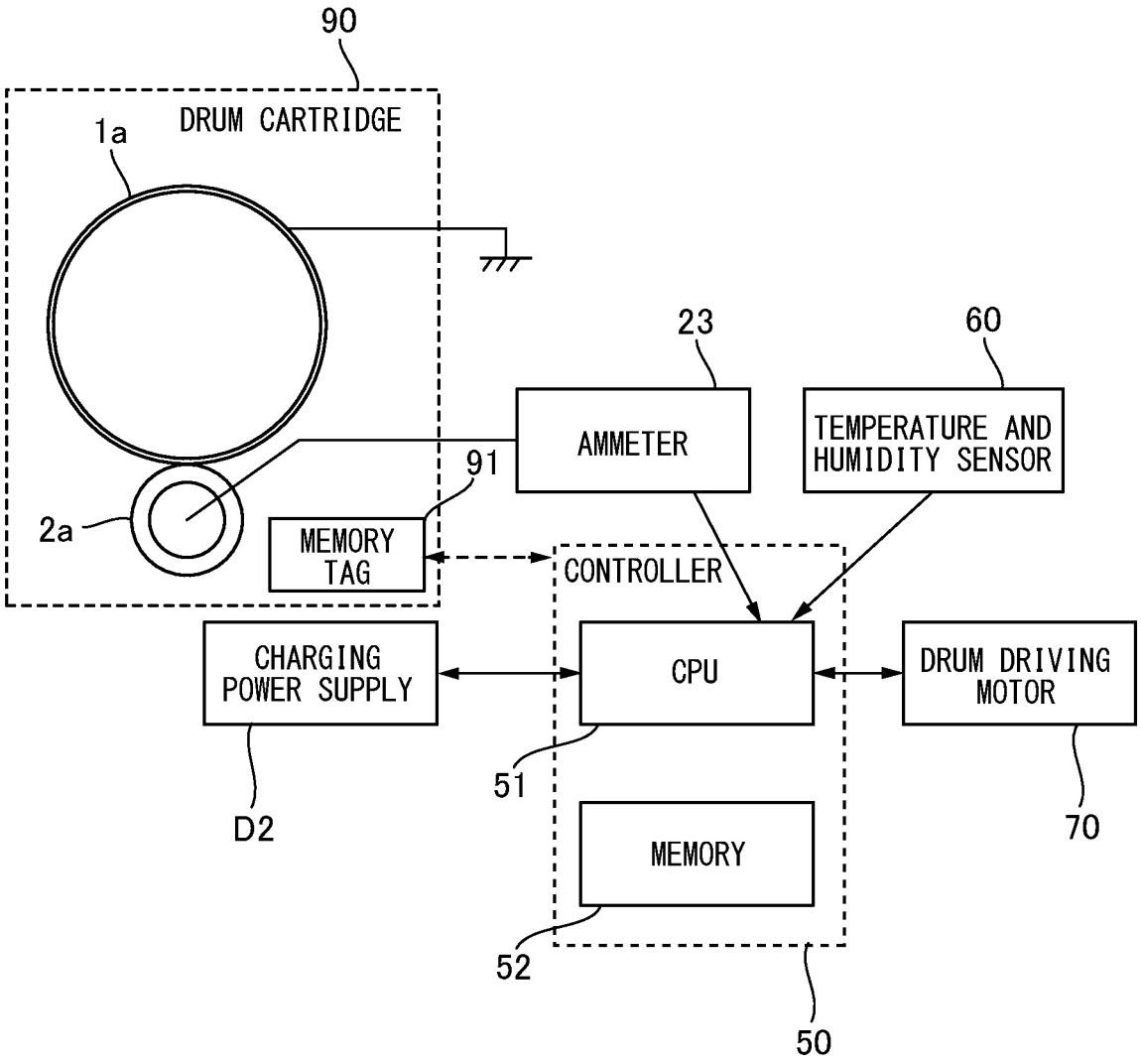
FIG. 3 is a control block diagram for describing a controller.

As illustrated in FIG. 3, a memory tag 91 is provided in a drum cartridge 90 as a photosensitive member unit. The memory tag 91 serving as a storage portion is, for example, a nonvolatile memory. According to the present embodiment, a "correction voltage value" measured under a specific condition during manufacture of the drum cartridge 90, which is called a representative correction value for distinction, is stored together with "measurement condition data" in the memory tag 91. If the drum cartridge 90 is exchanged by the user, the memory tag 91 is connected to the controller 50 in a manner capable of communicating data therewith, and the controller 50 can acquire the data stored in the memory tag 91.

Figure 9:
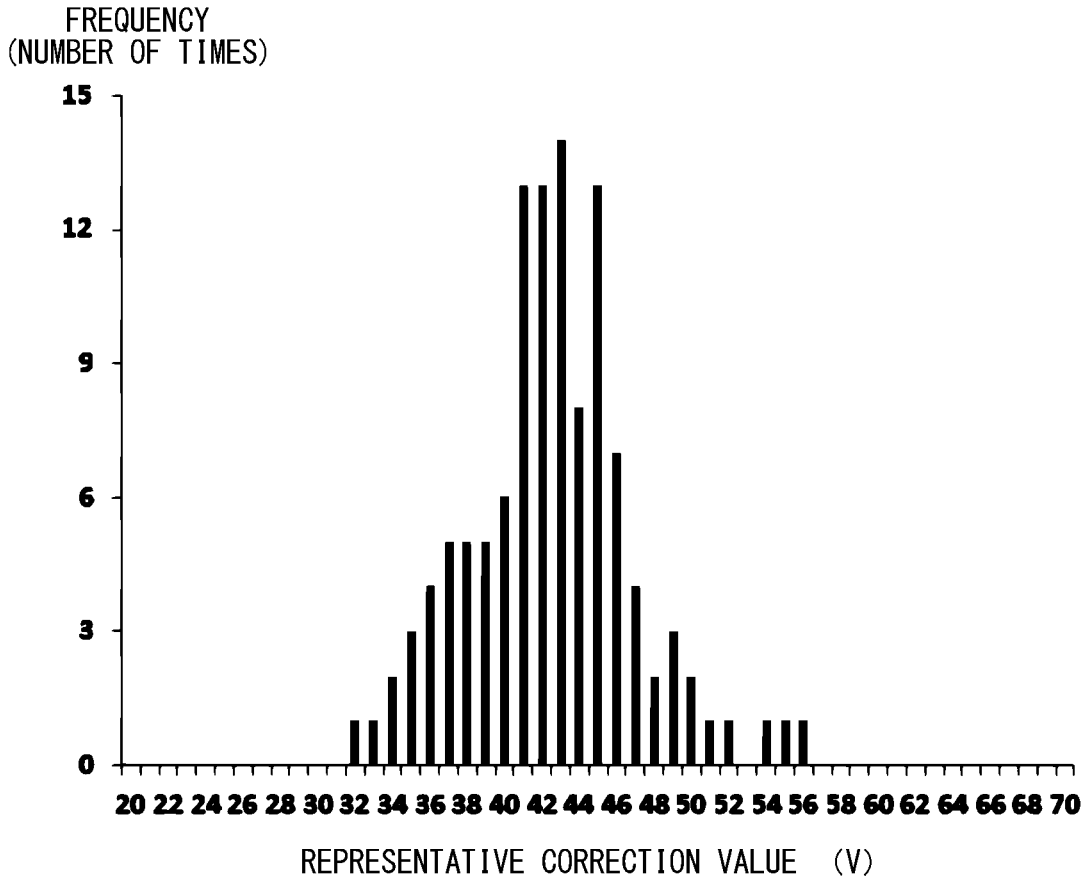
FIG. 9 is a histogram illustrating a distribution of correction voltage values of a large number of photosensitive drums subjected to actual measurement under a same measurement condition.

The reason for storing the "representative correction value" and the "measurement condition data" in the memory tag 91 will be described. FIG. 9 illustrates the distribution of representative correction values of the large number of photosensitive drums 1*a* subjected to actual measurement under the same measurement condition. Actual measurement results of 100 drum cartridges 90 of a case where the measurement was carried out in an environment where the temperature was 23° C., the humidity was 50% and the peripheral speed of the photosensitive drum 1*a* was set to "320 mm/sec" are shown. As illustrated in FIG. 9, the representative correction values subjected to actual measurement under the above-stated measurement condition were dispersed among the respective photosensitive drums 1*a*. Therefore, if the "correction voltage value table" (refer to Tables 1 to 3) stored in the memory 52 is used as it is to set the charging voltage (Vc) after the drum cartridge 90 has been exchanged, the photosensitive drum 1*a* may be charged to a potential that is deviated by a maximum of approximately 15 V from the target potential.

Therefore, in order to suppress the photosensitive drum 1*a* from not being charged to target potential after the exchange, the "representative correction value" and the "measurement condition data" are stored in the memory tag 91 to enable the "correction voltage values" in the "correction voltage value table" to be changed based thereon. That is, if the drum cartridge 90 is exchanged, the controller 50 reads the "representative correction value" together with the "measurement condition data" from the memory tag 91, arbitrarily changes the "correction voltage values" in the "correction voltage value table" based thereon and uses the values for setting the charging voltage (refer to Expression (2)).

The procedure for storing the "representative correction value" and the "measurement condition data" in the memory tag 91 will be described. Although not shown, a potential measuring apparatus for measuring the surface potential of the photosensitive drum 1*a* at the developing position b (refer to FIG. 2) is provided in a measurement apparatus for measuring the "representative correction value" for each drum cartridge 90. For better understanding, this procedure will be described with reference to FIG. 2.

When the drum cartridge 90 is attached to the measurement apparatus, the measurement apparatus rotates the photosensitive drum 1*a* and starts destaticization by the destaticizing exposing unit 7*a*. In a state where the peripheral speed of the photosensitive drum 1*a* is stable, the measurement apparatus applies a first applied voltage (V1) that is greater than the discharge start voltage to the charging roller 2*a*. While applying the first applied voltage (V1), the measurement apparatus measures the surface potential (Vd1) of the photosensitive drum 1*a* at the developing position b (refer to FIG. 2) and the current (I1) flowing through the charging roller 2*a* to the photosensitive drum 1*a*. Next, the measurement apparatus applies a second applied voltage (V2) that is greater than the first applied voltage (V1) to the charging roller 2*a* and measures the surface potential (Vd2) of the photosensitive drum 1*a* at the developing position b and the current (I2) flowing through the charging roller 2*a* to the photosensitive drum 1*a*. After completing measurement, the measurement apparatus stops both application of voltage to the charging roller 2*a* and rotation of the photosensitive drum 1*a*.

The measurement apparatus calculates the "representative correction value" based on the surface potential and the current acquired in the above manner using Expression (3) stated below. The measurement apparatus stores the calculated "representative correction value" in the memory tag 91 provided in the drum cartridge 90. Further, the measurement apparatus stores the above-mentioned measurement condition, such as temperature and humidity during measurement or peripheral speed of the photosensitive drum 1*a*, as "measurement condition data" in the memory tag 91 together with the "representative correction value". Thus, the drum cartridge 90 including the memory tag 91 storing the "representative correction value" and the "measurement condition data" as "information regarding the correction value" is packed and shipped as a product.

$$\text{Representative correction value}=(V1\times I2-V2\times I1)/(I2-I1)-(V1\times Vd2-V2\times Vd1)/(Vd2-Vd1) \quad \text{Expression (3)}$$

Correction Value Change Processing

Next, the "correction value change processing" for changing the "correction voltage value" in the "correction voltage value table" stored in the memory 52 in a case where a new drum cartridge 90 is installed in the image forming apparatus 100 will be described based on FIG. 10 with reference to FIGS. 2 and 3. The "correction value change processing" according to the present embodiment is executed by the controller 50 (refer to FIG. 3). The controller 50 executes the "correction value change processing" illustrated in FIG. 10 when power is turned on after the new drum cartridge 90 has been installed by the user.

Figure 10:
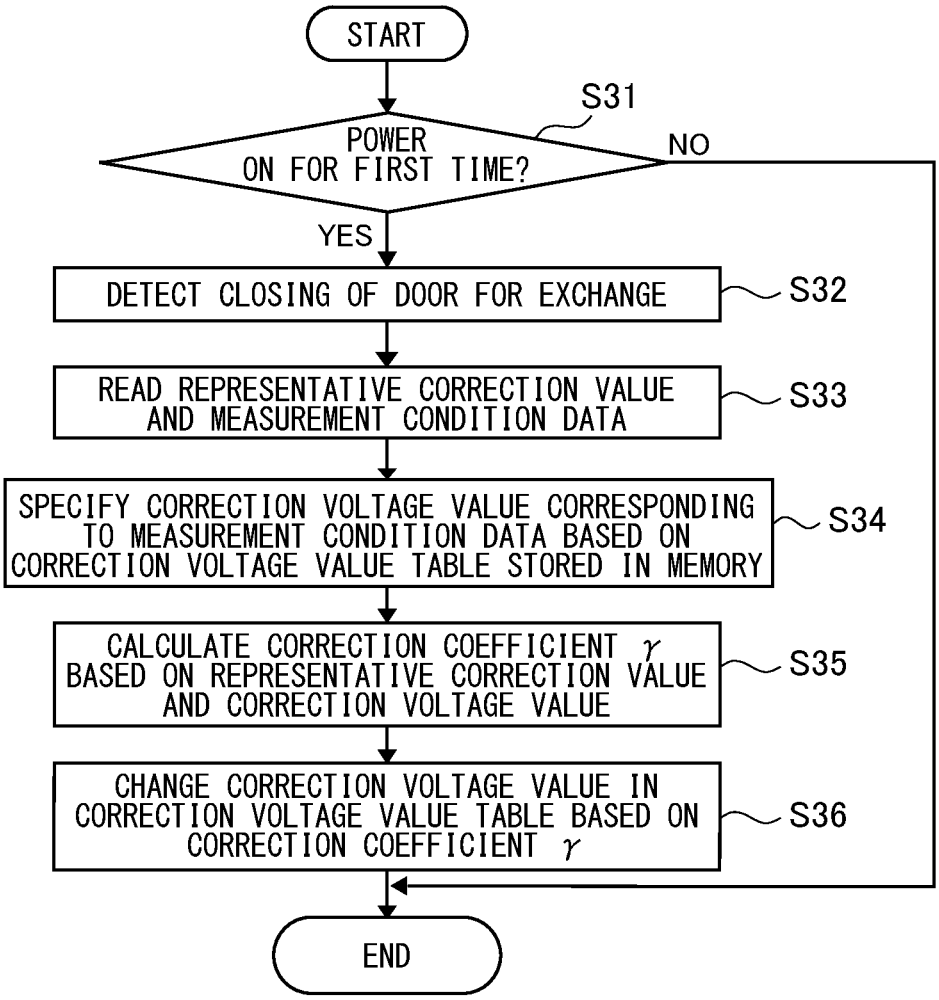
FIG. 10 is a flowchart illustrating a correction value change processing.

As illustrated in FIG. 10, the controller 50 determines whether the power of the apparatus is turned on for the first time after the drum cartridge 90 had been exchanged (S31). If it is not the first time the power of the apparatus is turned on after the drum cartridge 90 had been exchanged (S31: NO), the controller 50 ends the correction value change processing. Meanwhile, if it is the first time the power of the apparatus is turned on after the drum cartridge 90 had been exchanged (S31: YES), processing of the controller 50 is set to stand-by until the door (not shown) for exchanging the drum cartridge is closed (S32). Then, in response to the closing of the door for exchanging the drum cartridge, the controller 50 reads the "representative correction value" and the "measurement condition data" from the memory tag 91 of the installed drum cartridge 90 (S33).

The controller 50 specifies the "correction voltage value" corresponding to the "measurement condition data" read from the memory tag 91 based on the "correction voltage value table" (refer to Tables 1 to 3) stored in the memory 52 (S34). For example, if the "correction voltage value table" illustrated in Table 1 is stored in the memory 52 and the "measurement condition data" is the "peripheral speed (320 mm/sec)", "35 V" is specified as the corresponding "correction voltage value". Then, the controller 50 calculates a "correction coefficient (γ)" by dividing the "representative correction value" read from the memory tag 91 by the specified "correction voltage value" (S35) and changes the "correction voltage value" of the "correction voltage value table" based on the calculated "correction coefficient (γ)" (S36).

In this case, the changed "correction voltage value" that has been calculated by multiplying the original "correction voltage value" and the "correction coefficient (γ)" is stored in the memory 52 as the "correction voltage value table". Therefore, when executing the above-described "charging voltage-setting processing", the "correction voltage value" that had been changed based on the "correction coefficient (γ)" is used, and the charging voltage is set. In other words, the charging voltage (Vc) is actually set based on the following Expression (4).

$$\text{Charging voltage } (Vc) = \text{reference voltage value} - \text{original correction voltage value} \times \text{correction coefficient } (\gamma) \quad \text{Expression (4)}$$

As described, in a case where the photosensitive drum 1*a* is provided in an exchangeable manner, the charging voltage (Vc) can be set using the changed "correction voltage value" that had been changed according to the "representative correction value" that may differ for each of the different photosensitive drums 1*a*. Thereby, the surface potential of the photosensitive drum 1*a* can be charged to the target potential while eliminating the influence of dispersion of the "representative correction values" of the respective photosensitive drums 1*a* as illustrated in FIG. 9. Therefore, even if the photosensitive drum 1*a* is exchanged, the surface potential of the photosensitive drum 1*a* can be charged to an appropriate target potential both before and after the exchange, so that the generation of image defects accompanying the exchange of the photosensitive drum 1*a* can be suppressed.

The respective embodiments described above have been illustrated regarding the image forming apparatus 100 configured to primarily transfer toner images of respective colors from the photosensitive drums 1*a* to 1*d* to the intermediate transfer belt 10 before secondary transfer of the toner images of respective colors collectively to the recording material P, but the present technique is not limited to these embodiments. For example, the technique can be applied to a direct transfer-type image forming apparatus in which transfer is performed directly from the photosensitive drums 1*a* to 1*d* to the recording material P.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-102059, filed on Jun. 12, 2020, which is hereby incorporated by reference herein in its entirety.

What is claimed is:

1. An image forming apparatus comprising:

a photosensitive member;

a driving unit configured to rotate the photosensitive member;

a charging member configured to charge a surface of the photosensitive member by abutting against the photosensitive member and having a DC voltage having only a DC component applied;

an image forming unit configured to form an image on the photosensitive member being charged and to form the image on a recording material;

a power supply configured to apply the DC voltage to the charging member;

a current detection unit configured to detect a current value flowing from the charging member to the photosensitive member;

a calculation unit configured to respectively detect current values when DC voltages with different DC voltage values, each having a greater absolute value than a discharge start voltage, are applied to the charging member, and calculate a first DC voltage value corresponding to the discharge start voltage based on the DC voltage values and the current values; and a setting unit configured to set a second DC voltage value of a constant amplitude to be applied to the charging member during forming of the image based on the first DC voltage value, a target voltage value, and a correction value corresponding to a peripheral speed of the photosensitive member during forming of the image.

2. The image forming apparatus according to claim 1, wherein in a case where a peripheral speed of the photosensitive member is a first speed, a first correction value is set as the correction value corresponding to the peripheral speed of the photosensitive member, and in a case where a peripheral speed of the photosensitive member is a second speed that is faster than the first speed, a second correction value that is greater than an absolute value of the first correction value is set as the correction value corresponding to the peripheral speed of the photosensitive member.

3. The image forming apparatus according to claim 2, further comprising:

a storage portion configured to store information, wherein the storage portion is configured to store the first correction value and the second correction value.

4. The image forming apparatus according to claim 1, further comprising:

a photosensitive member unit comprising the photosensitive member and configured to be detachably attached to the image forming apparatus, wherein the photosensitive member unit comprises a storage portion configured to store information regarding the correction value.

* * * * *